US007784380B2

(12) United States Patent
Berger et al.

(10) Patent No.: US 7,784,380 B2
(45) Date of Patent: Aug. 31, 2010

(54) DRIVE SPINDLE FOR THE MAIN DRIVE OF A ROLL STAND

(75) Inventors: Maik Berger, Chemnitz (DE); Achim Klein, Kreuztal (DE); Florian Lindner, Netphen (DE); Peter Rainer, Hilchenbach (DE)

(73) Assignee: SMS Siemag Aktiengesellschaft, Dusseldorf (DE)

( * ) Notice: Subject to any disclaimer, the term of this patent is extended or adjusted under 35 U.S.C. 154(b) by 954 days.

(21) Appl. No.: 11/596,936

(22) PCT Filed: Apr. 10, 2006

(86) PCT No.: PCT/EP2006/003271

§ 371 (c)(1),
(2), (4) Date: Nov. 17, 2006

(87) PCT Pub. No.: WO2006/108596

PCT Pub. Date: Oct. 19, 2006

(65) Prior Publication Data

US 2007/0251349 A1 Nov. 1, 2007

(30) Foreign Application Priority Data

Apr. 12, 2005 (DE) ..... 10 2005 016 629
Nov. 17, 2005 (DE) ..... 10 2005 054 742

(51) Int. Cl.
*B23Q 16/00* (2006.01)

(52) U.S. Cl. ..... 74/825

(58) Field of Classification Search ..... 74/825, 74/826; 72/237, 245, 249; 403/301, 359.5; 100/269.06, 269.07; 464/112, 113, 128, 464/129

See application file for complete search history.

(56) References Cited

U.S. PATENT DOCUMENTS 2,332,859 A * 10/1943 Kreissig et al. ..... 464/58
2,430,683 A * 11/1947 O'Malley ..... 464/154

(Continued)

FOREIGN PATENT DOCUMENTS

| | | |
|---|---|---|
| DE | 23 62 524 | 6/1975 |
| DE | 102 11 883 | 12/2003 |
| EP | 0 324 168 | 7/1989 |

*Primary Examiner*—Vicky A Johnson
(74) *Attorney, Agent, or Firm*—Lucas & Mercanti, LLP; Klaus P. Stoffel

(57) ABSTRACT

The invention concerns a drive spindle (1) for the main drive of a rolling stand, which has: a first shaft (3) for transmitting torque from a drive motor (2) to a coupling element, especially to a multiple spline profile, and a second shaft (5) for transmitting the torque from the coupling element, especially the multiple spline profile, via a swivel joint (4) to a roll (6) of the rolling stand, wherein the swivel joint (4) has a wobbler (7), which is rotationally rigidly connected with the roll (6), and a second spindle head (8), which is rotationally rigidly connected with the second shaft (5), and wherein the rotational connection between the wobbler (7) and the spindle head (8) is produced by sliding bearings and a journal (9), which is rotationally rigidly connected with the spindle head (8) but is supported in a way that allows an angle of inclination ($\alpha$) between the axis of rotation (10) of the roll (6) and the axis of rotation (11) of the second shaft (5). In order to achieve improved transmission of axial forces by the swivel joint, the invention provides that a bearing element (12, 13) for absorbing forces in the direction of the axes of the second shaft (5) and the roll (6) is arranged between the wobbler (7) and the spindle head (8), such that a push rod (14) for transmitting axial forces between the wobbler (7) and the spindle head (8) is arranged between the two bearing elements (12, 13).

21 Claims, 7 Drawing Sheets

U.S. PATENT DOCUMENTS 3,020,735 A * 2/1962 Wegmann ..... 464/113
5,782,127 A * 7/1998 Donini et al. ..... 72/247
6,062,058 A * 5/2000 Buchegger ..... 72/249
7,021,104 B2 * 4/2006 Drigani et al. ..... 72/241.2

* cited by examiner

DRIVE SPINDLE FOR THE MAIN DRIVE OF A ROLL STAND

The invention concerns a drive spindle for the main drive of a rolling stand, which has: a first shaft for transmitting torque from a drive motor to a coupling element, especially to a multiple spline profile, and a second shaft for transmitting the torque from the coupling element, especially the multiple spline profile, via a swivel joint to a roll of the rolling stand, wherein the swivel joint has a wobbler, which is rotationally rigidly connected with the roll, and a second spindle head, which is rotationally rigidly connected with the second shaft, and wherein the rotational connection between the wobbler and the spindle head is produced by sliding bearings and a journal, which is rotationally rigidly connected with the spindle head, but is supported in a way that allows an angle of inclination between the axis of rotation of the roll and the axis of rotation of the second shaft.

Drive spindles of this type for the rolling stand main drive often must be designed as an axial shift system to be able to effect a length compensation. Cardan shafts with Hooke's joints are generally used for this purpose.

DE 102 11 883 C1 discloses a solution of this type, wherein in this case an effort is made to equip the Hooke's joint of a Cardan shaft for driving the rolls of a rolling mill with a holding device, which can be adjusted to different fixed angles of inclination of the Cardan shaft. To this end, a special design of the Cardan shaft is proposed, in which base parts, together with holding bolts, are mounted on the yoke arms of the journal joint.

DE 29 26 710 C2 likewise proposes a universal joint assembly with Hooke's joints for driving the rolls of a rolling stand. To design a Cardan shaft without limitation of the rotational diameter in such a way that the angle of inclination of each Hooke's joint during shutdown of the Cardan shaft can be limited to any desired value, it is proposed that one end of a bolt located in the Hooke's joint is angularly movably received in a member of one of the joint yokes which can move radially relative to the coupling axis, while the movable member can be fixed in any desired position by locking means.

DE 32 31 752 C1 discloses a wobbler with automatic play compensation for connecting a roll neck with a drive spindle for a rolling stand. Wedge-shaped catches for the roll necks are provided, which are slidingly installed on two prism faces that interact in pairs, are inclined towards the inside of the wobbler towards the center, and in their angle of inclination correspond to the wedge angle of the catches. The aim is for the play compensation to be effective on all sides of the roll neck and to be capable of automatically compensating dimensional differences which are caused by wear or arise during roll changes.

DE 197 45 199 C1 discloses another design of a Cardan shaft for driving a roll of a rolling mill. Here too, Hooke's joints are used for rotationally rigid connection of two shaft parts with each other, but in such a way that angular movement between them is possible. The same is true of the solution disclosed in EP 1 393 826 A1.

Cardan shafts with Hooke's joints are delicately constructed and are thus expensive. In addition, it is usually necessary to maintain them in special workshops, which requires considerable logistical work.

In principle, it is also possible to use flat-journal spindles instead of Hooke's joints in the drive spindle for driving rolls. A solution of this type is disclosed in DE-OS 23 62 524. It describes an axially shiftable, automatically engageable and disengageable joint coupling of the drive spindle for changeable rolling stands, with which fast engagement and disengagement of the coupling and reliable catching during the shifting of the rolling stand are supposed to be made possible.

However, this solution makes it difficult or impossible to transmit axial forces efficiently via the flat-journal spindle without excessively loading the spindle. With a design of this type, it would be necessary, for purposes of length compensation of the drive spindle, to equip the motor-side spindle head with moving cylinders and automatically to control the cylinders in such a way that the roll axial shift is guided parallel. Only in this way would it be possible to ensure that the roll-side spindle head cannot slip from the roll. Not only does this constitute an unacceptable expense, but also in the event of a malfunction, considerable damage to the rolling mill could occur.

Therefore, the objective of the invention is to equip a drive spindle for the main drive of a rolling stand of the aforementioned type with a flat-journal spindle in such a way that the specified disadvantages are avoided. We thus wish to create a robust, simply designed, and thus inexpensive and easily maintained assembly, which is suitable even for carrying out the function of length compensation of the drive spindle. In addition, it is desired that the coupling can remain rigidly connected with the roll.

The solution to this problem in accordance with the invention is characterized by the fact that a bearing element for absorbing forces in the direction of the axes of the second shaft and the roll is arranged between the wobbler and the spindle head that is located close to the roll, such that a push rod for transmitting axial forces between the wobbler and the spindle head is arranged between the two bearing elements.

In accordance with the invention, a push rod is integrated in the swivel joint and interacts with special bearing elements to transmit axial forces.

As will later become apparent, an axial balancing force can be transmitted in this way via the push rod, so that the sliding bearings in the spindle head must transmit only the drive torque and are not loaded by the axial force. The drive spindle can thus be loaded at the same level as would be the case without length compensation.

It is also advantageous that the wobbler can remain on the roll. An additional spindle head mount is not necessary.

Finally, when a roll change is carried out, it is advantageous that it is not necessary to operate an additional locking element, e.g., a pin, as is sometimes the case in the state of the art discussed above.

In a first refinement of the invention, the two bearing elements are arranged concentrically to the axis of rotation of the roll and the axis of rotation of the second shaft, respectively.

Each of the bearing elements, preferably together with the push rod, forms a sliding bearing. In this regard, the bearing elements can have a concave cross-sectional shape in the area of contact with the push rod, and the end regions of the push rod can have a convex shape corresponding to this concave shape. It is especially advantageous if the bearing elements have an essentially hemispherical cross-sectional shape in the area of contact with the push rod.

The journal can have an essentially plate-like design and a recess for the passage of the push rod. The recess preferably has a conical shape, so that the push rod can be moved within certain angular limits.

To facilitate a roll change, it is possible to provide means by which the push rod is connected with the wobbler and/or with the spindle head in a way that prevents it from falling out.

It is advantageous for the push rod to be designed in the form of a pin, i.e., it then has a circular cross section. The ratio of its length to its diameter is preferably 4 to 10 and especially 5.5 to 8.5. The radius of the hemispherical sections of the bearing elements and push rod is preferably between half as great and twice as great as the diameter of the push rod. In general, it can be said that the radii of the areas of contact between the bearing elements and the push rod should be chosen sufficiently large to keep wear at a low level. Although the relative movement increases essentially linearly with increasing radius, the contact pressure decreases quadratically with increasing radius. Therefore, the radius is preferably selected as large as possible.

To ensure a long service life and good operation, a lubricant channel can be provided, which passes through the spindle head and opens into the contact area between at least one of the bearing elements and the push rod to supply lubricant to the contact area. In an especially preferred embodiment of the invention, the lubricant channel opens only into the contact area between one of the bearing elements and the push rod, and the push rod has a longitudinal bore that passes through it for conveying lubricant into the area of the other bearing element.

The materials of which the components are made can also be chosen in such a way that good friction properties are obtained. Therefore, it is advantageous to produce the bearing elements from a self-lubricating material, especially one which contains graphite.

The application of balancing forces, which in itself is already well known, can be accomplished by installing, on at the first shaft, a bearing box that is suitable for applying these balancing forces to the second shaft.

In a modification of the invention, the push rod consists of several components that are connected with one another. In particular, the push rod can consist of a rod element and a push rod head mounted at each end of the rod element. In this case, the components can be connected with one another by screw connections. This design of the push rod with several components has the advantage that when wear occurs, it is possible to replace only one head of the push rod. A design with a large push rod head sometimes requires detachability, because only then can the slender middle section of the push rod be inserted through the passage opening in the journal.

To achieve better heat removal, especially from the contact point between the push rod and the bearing elements, it has been found to be effective to provide fins, which are preferably located in the vicinity of at least one of the axial ends of the push rod. Furthermore, the cooling of the spindle and again the point of contact between the push rod and the bearing elements is improved if the push rod has at least one bore for passing a cooling medium through it; in this connection, it is advantageous for at least one bore to be arranged in the axial end region of the push rod. Efficient cooling can thus be achieved by passing a cooling medium, for example, water, through the bore.

The proposal of the invention creates the possibility of making previously known flat-journal spindles especially well suited even for roll axial shift systems in large rolling stands.

Specific embodiments of the invention are illustrated in the drawings.

FIG. 1*a* shows a side view of two drive spindles for the main drive of two rolls of a rolling stand.

FIG. 1*b* shows a top view of the drive spindles shown in FIG. 1*a*.

Figure 1A:
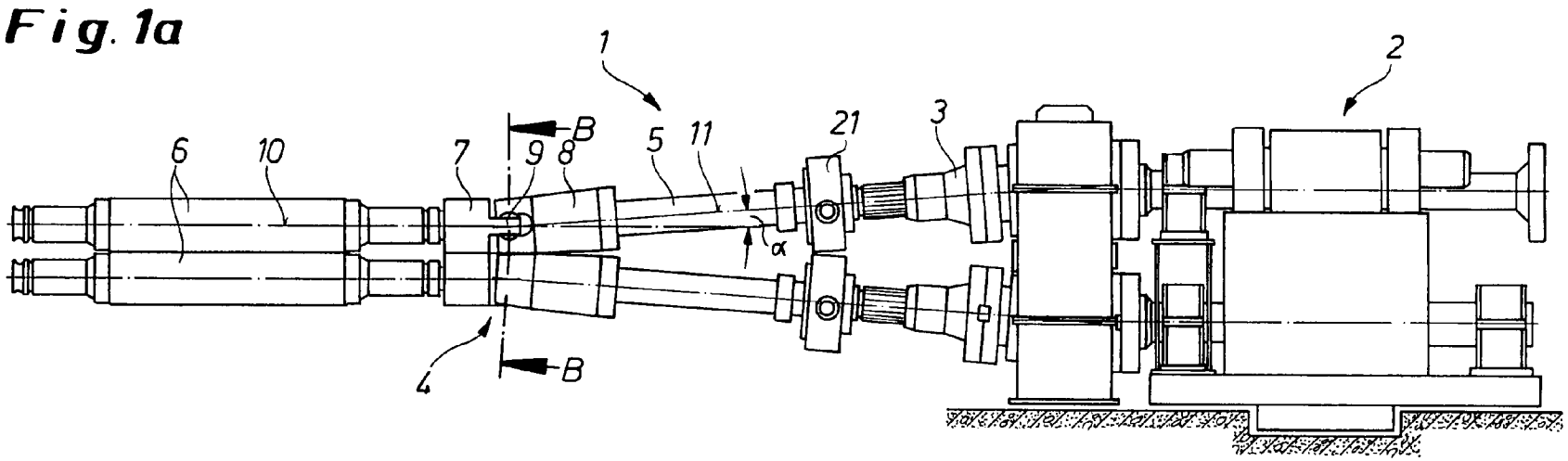
Figure 1B:
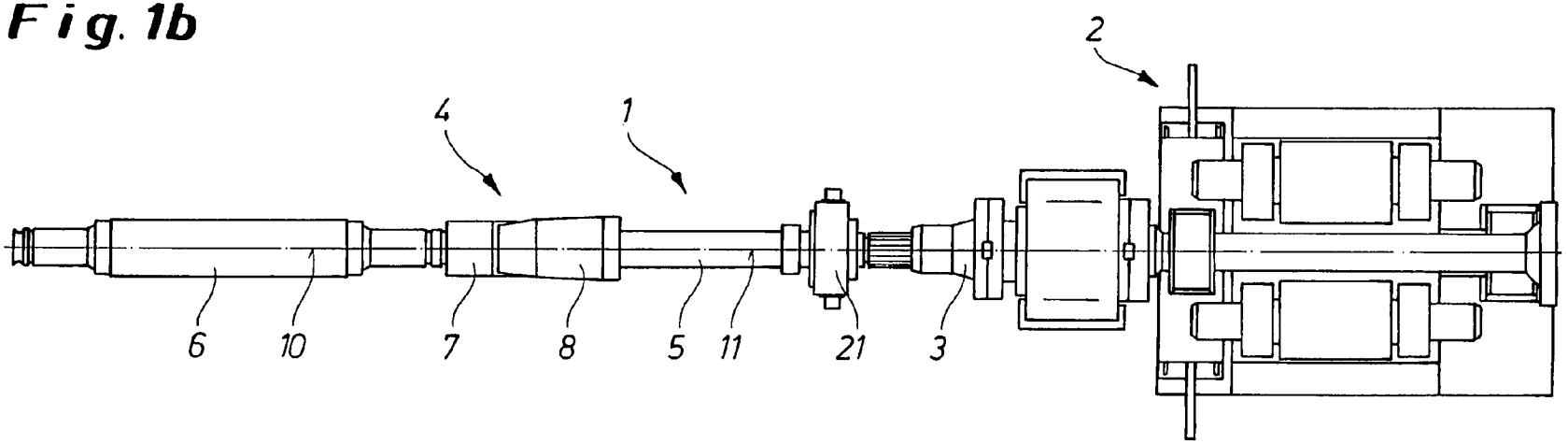

FIGS. 1*a* and 1*b* show two drive spindles 1 for driving two rolls 6 in a rolling stand. It should be noted that the lower spindle in FIGS. 1*a*, 2, 3, and 4 is drawn in a position that is rotated 90° relative to the upper spindle to show the structure of the system better. The drive spindles 1 are driven (on the right) by drive motors 2. The torque of the motors is transmitted to the rolls 6 (on the left). Both drive spindles 1 have two shafts 3 and 5. The roll 6 rotates about a horizontal axis of rotation 10. However, the second axis of rotation 11 of the shafts 3 and 5 is oriented at a slight angle of inclination $\alpha$ relative to the horizontal, e.g., 2° to 12°.

To allow the torque to be transmitted despite the angle of inclination $\alpha$, a swivel joint 4 is arranged between the roll 6 and the second shaft. It is designed as a flat-journal joint. The swivel joint 4 consists of two elements, namely, the wobbler 7 and the spindle head 8, which are rotationally rigidly connected with each other but in such a way that they can swivel relative to each other. A journal (flat journal) 9 is formed on the wobbler 7 and extends into and is supported in a corresponding recess in the spindle head 8.

Figure 2:
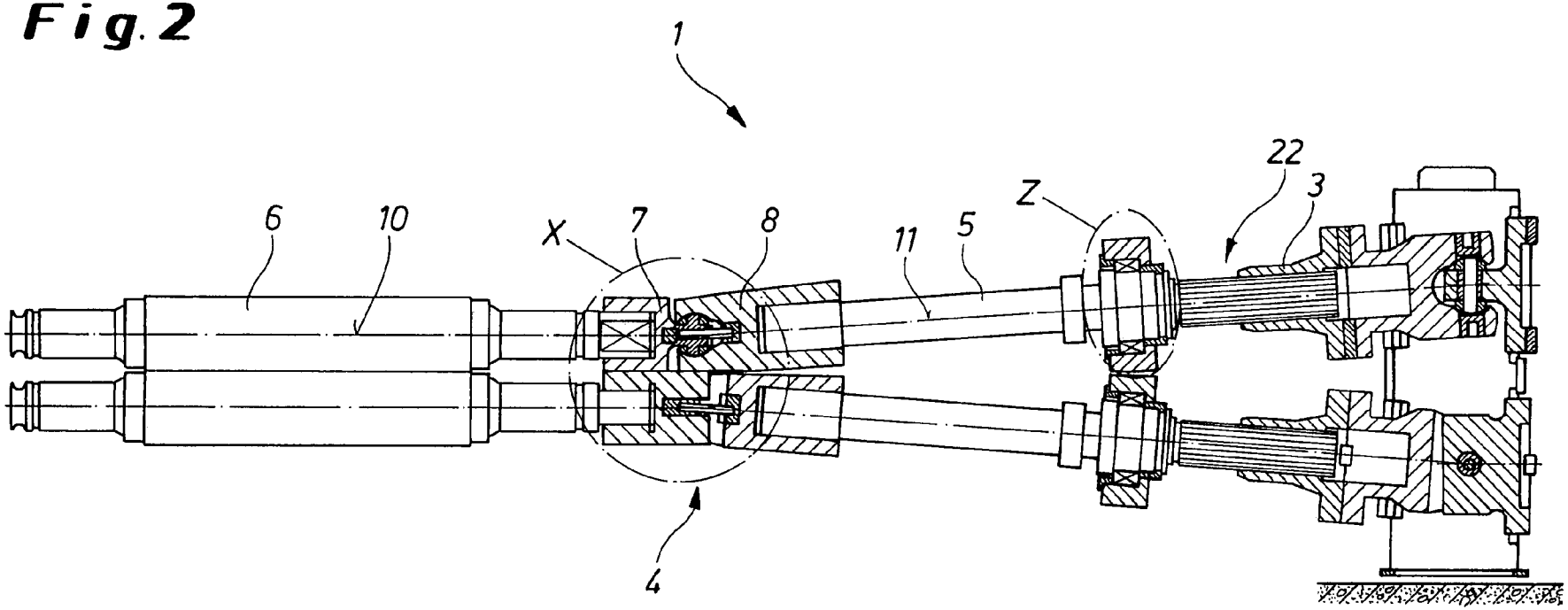
FIG. 2 shows an enlarged view of the two drive spindles shown in FIG. 1*a*.

At its end facing away from the swivel joint 4, the second shaft 5 is connected with the first shaft 3 by a coupling element in the form of a multiple spline profile (see FIG. 2). This allows axial displacement between the shafts 3 and 5 and thus between the rolls 6.

Figure 3:
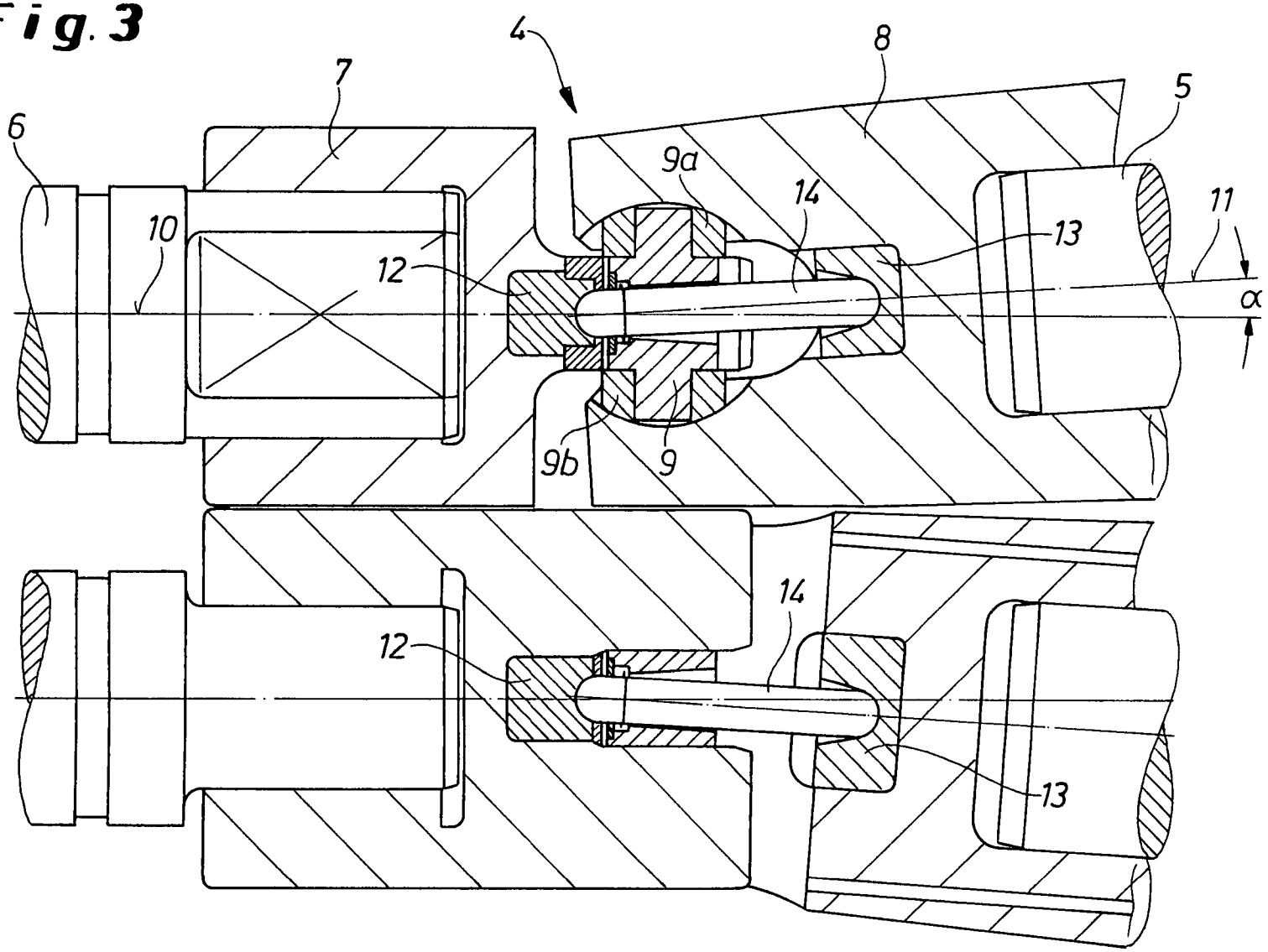
FIG. 3 shows the detail "X" according to FIG. 2.
Figure 4:
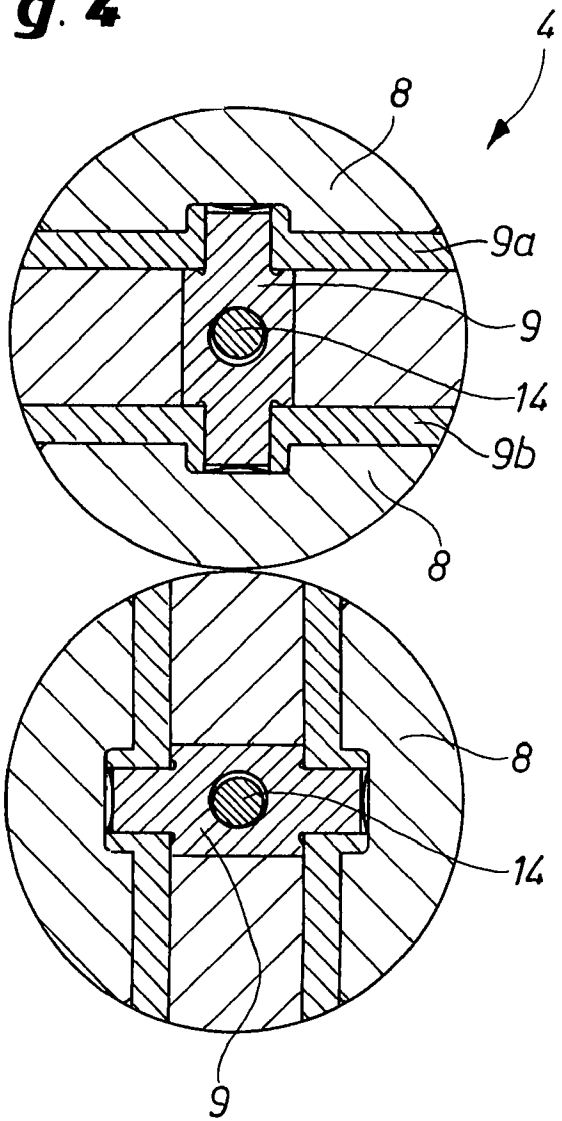
FIG. 4 shows the section B-B according to FIG. 1*a*.
Figure 5:
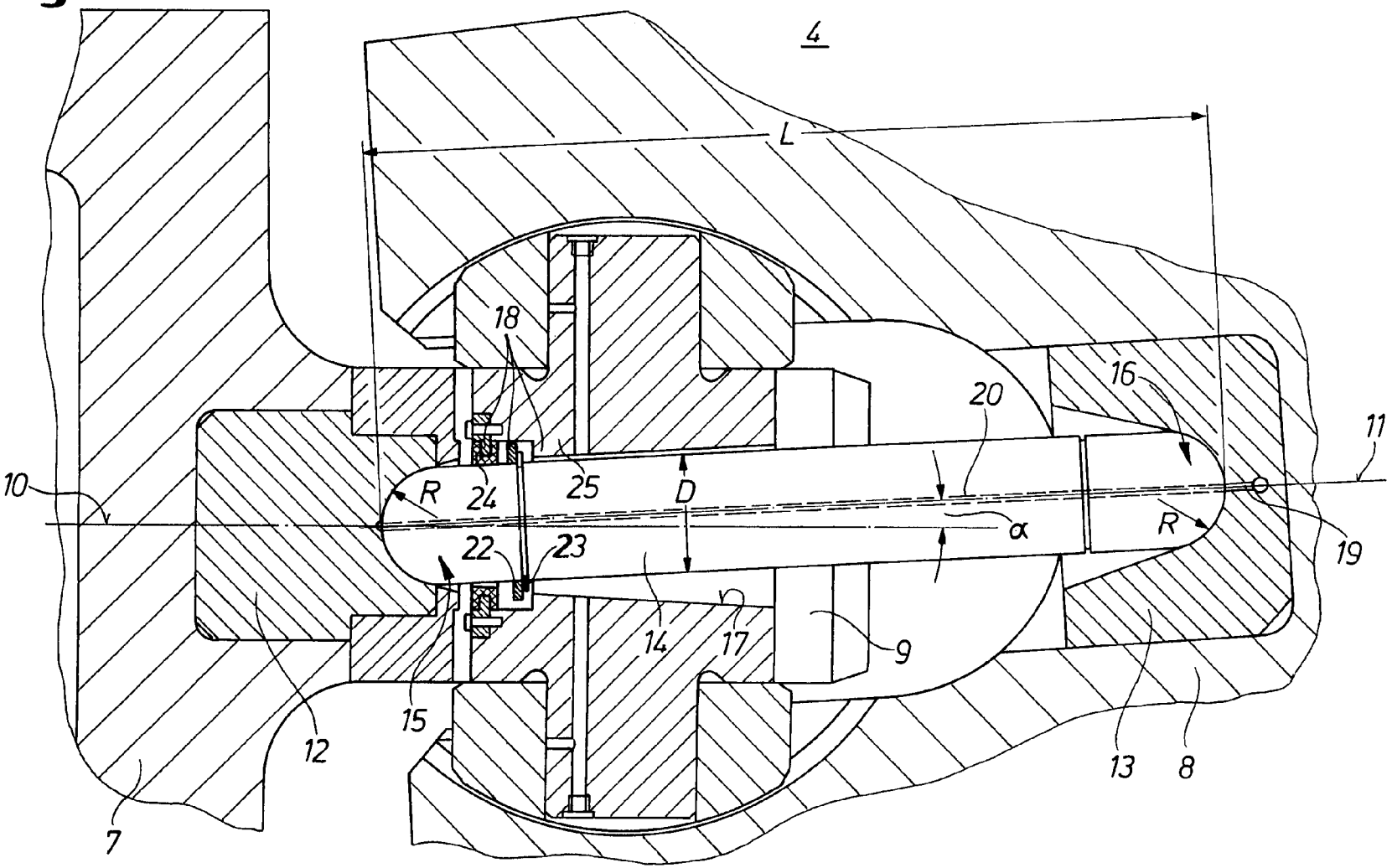
FIG. 5 shows an enlarged view of the upper part of FIG. 3.

FIGS. 3, 4, and 5 show the detailed structure of the swivel joint 4.

The wobbler 7 and the spindle head 8 each has a bearing element 12 and 13, respectively, in the area of the corresponding axis of rotation 10 and 11, respectively. The bearing element 12 or 13 has a block-like design and is inserted in the wobbler 7 or in the spindle head 8. On the side of each bearing element 12, 13 that faces the other part, the bearing element 12, 13 has a dome-shaped concave recess, i.e., a hemispherically shaped recess, as is best shown in FIG. 5. In this regard, the radius R of the dome-shaped recess is between half as great and twice as great as the push rod diameter D. As was mentioned earlier, the radius R is chosen sufficiently large to keep wear at a low level. The contact pressure between the bearing element 12, 13 and the push rod 14 is thus kept low.

A push rod 14, which is positioned between the two bearing elements 12, 13, is suitably designed for transmitting axial forces from one spindle head to the other. This ensures that the journal 9 itself is not loaded by axial forces; the journal 9 only has to hold the sliding bearings 9*a* and 9*b* (see FIGS. 3 and 4).

The push rod 14 is designed as a cylindrical pin, and its two end regions 15 and 16 are shaped to correspond to the dome shape of the bearing elements 12, 13.

The journal 9 has a conically shaped recess 17, which is suitable for the axial passage of the push rod 14 (see FIG. 5). To prevent the push rod 14 from falling out when the two parts, i.e., the wobbler 7 and the spindle head 8, are separated from each other, the push rod 14 is secured in the spindle head 8 in a way that prevents it from falling out. Means 18 are provided for this purpose. As FIG. 5 shows, these means 18 consist of a ring 22, which is secured on the push rod 14 by a securing element 23. The axial freedom of motion of the push rod 14 relative to the spindle head 8 is limited by a screw-fastened locking element 24 and by a projection 25.

To guarantee reliable operation of the system, it is necessary to ensure that the sliding pair consisting of the bearing element and push rod is supplied with sufficient lubricant. To this end, the spindle head 8 contains a lubricant channel 19, whose mouth is located at the dome-shaped surface of the bearing element 13 where this surface intersects the axis of rotation 11. Lubricating grease is supplied under pressure at this point, so that the contact surface between the (right) end 16 of the push rod 14 and the bearing element 13 is well lubricated. So that the other bearing, i.e., the contact surface between the (left) end 15 of the push rod 14 and the bearing element 12 is supplied with lubricant, the push rod 14 is provided with a longitudinal bore 20 that passes centrally through the entire length of the push rod 14. Lubricating grease can pass through this bore from the right end of the push rod to the left end.

The push rod 14 does not undergo any rotation during the operation of the spindle system, but instead carries out a tumbling motion about its longitudinal axis. The lubricant supply that is provided ensures good lubrication of the bearings. The friction situation in the bearing can be improved by using self-lubricating materials.

During the mounting and dismounting of the roll 6, the flat journal 9 of the wobbler 7 is pushed into the spindle head 8. As noted above, the push rod 14 is held securely in the spindle head 8 to prevent it from falling out. When a new roll is being placed in position, one end (the left end) of the push rod 14 centers itself in the dome-shaped recess of the bearing element 12.

As FIG. 5 shows, it is provided that one of the two centers of rotation at the hemispherical ends of the push rod 14 is located on the roll axis, and the other is located on the spindle axis. It is further provided that the radii R at the ends of the push rod 14 are kept small (see the discussion above concerning the choice of radius, according to which, on the other hand, a sufficiently large radius R must be provided to maintain low contact pressure between the parts and thus a low level of wear). On the other hand, the length of the push rod 14 must be sufficiently great. In the illustrated embodiment, it is 400-600 mm. It is also advantageous for the two ends of the push rod to be close to the center of rotation of the spindle head located on the roll side. The relative motions in the contact areas between the bearing elements 12, 13 and the push rod 14 are smallest if the push rod 14 is mounted centrically with respect to the center of rotation of the spindle head. A dome-shaped end of the push rod, which would lie exactly in this center of rotation, would undergo a relative motion in the form of a tumbling motion corresponding to the angle of inclination $\alpha$ of the spindle, while the other end of the push rod would be subject to no relative motion. If the ends of the push rod are arranged centrically with respect to or at an equal distance from the center of rotation of the spindle head, they each undergo relative motions corresponding to half the spindle angle.

In order, on the one hand, to achieve high functional reliability of the system and, on the other hand, to prevent the risk of buckling of the push rod 14, the ratio of the length L of the push rod 14 to the diameter D of the push rod (see FIG. 5) is 4 to 10 and preferably 5.5 to 8.5.

Figure 6:
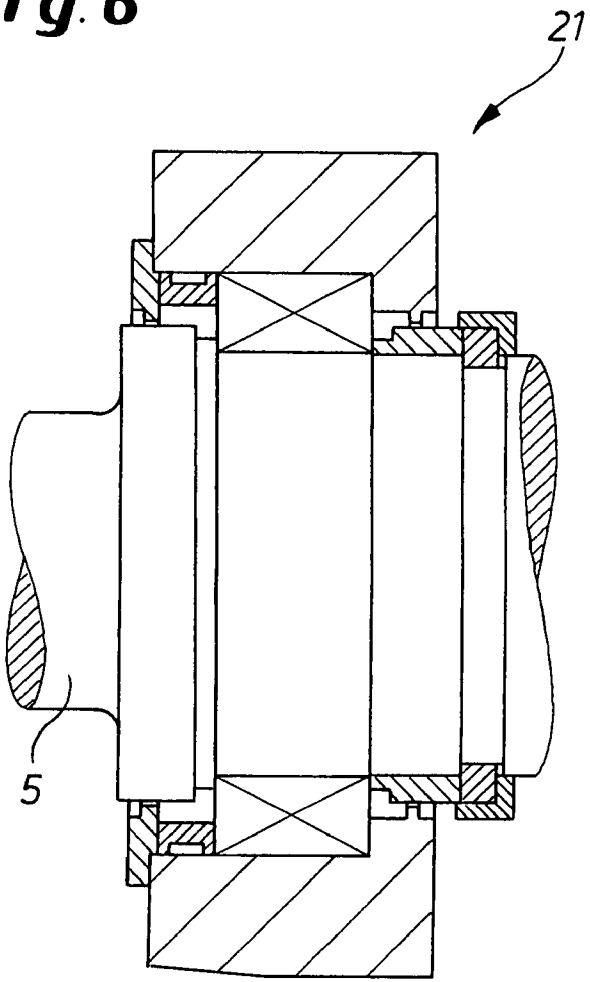
FIG. 6 shows the detail "Z" according to FIG. 2.

FIGS. 1*a* and 1*b* show that a bearing box 21 (shown in detail in FIG. 6) is installed in the (right) end region of the axially movable shaft 5. A lever system (not shown), the so-called balancing system, acts on the part of the bearing box 21 that does not co-rotate, i.e., on the outer part of the box. Vertical and horizontal forces can be applied with the balancing system, which in itself is already known. During axial shift of the roll 6 towards the center of the rolling stand (towards the left), there is the danger that the spindle head 8 will be pulled down by the flat journal 9 of the wobbler 7. To avoid this, a part of the articulated spindle is pressed towards the roll 6 with the balancing system. The compressive forces that are not dissipated by the friction in the length compensation, are further transmitted to the roll 6 by the push rod 14. After the axial shift towards the center of the stand has ended, the axial balancing force can be reduced.

The axial balancing force should act with full force only during an axial shift towards the center of the stand. Otherwise, during the shift in the opposite direction, the force on the push rod 14 would double. In the case of faulty control of this operation, the wear on the push rod 14 and on the bearings of the bearing elements 12, 13 increases. However, in contrast to the previously known solutions, slipping of the roll-side spindle head from the wobbler is not to be feared if the cylinder for the horizontal balancing is designed in such a way that it can apply only compressive forces and if its hydraulic pressure is coupled with the hydraulic pressure on the axial shifting cylinder of the roll 6.

Figure 7:
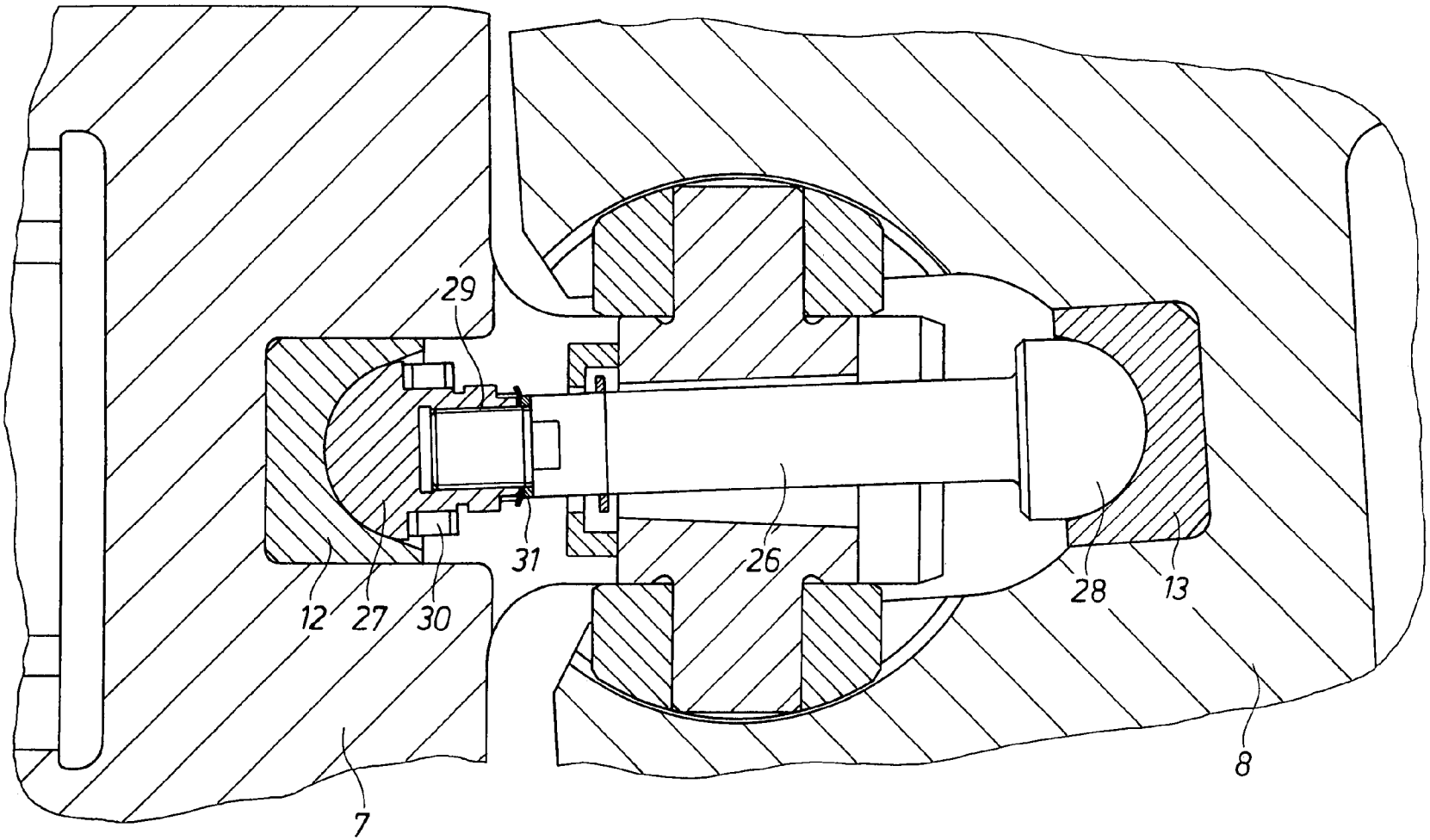
FIG. 7 shows an alternative design of the invention in the same view as FIG. 5.
Figure 8:
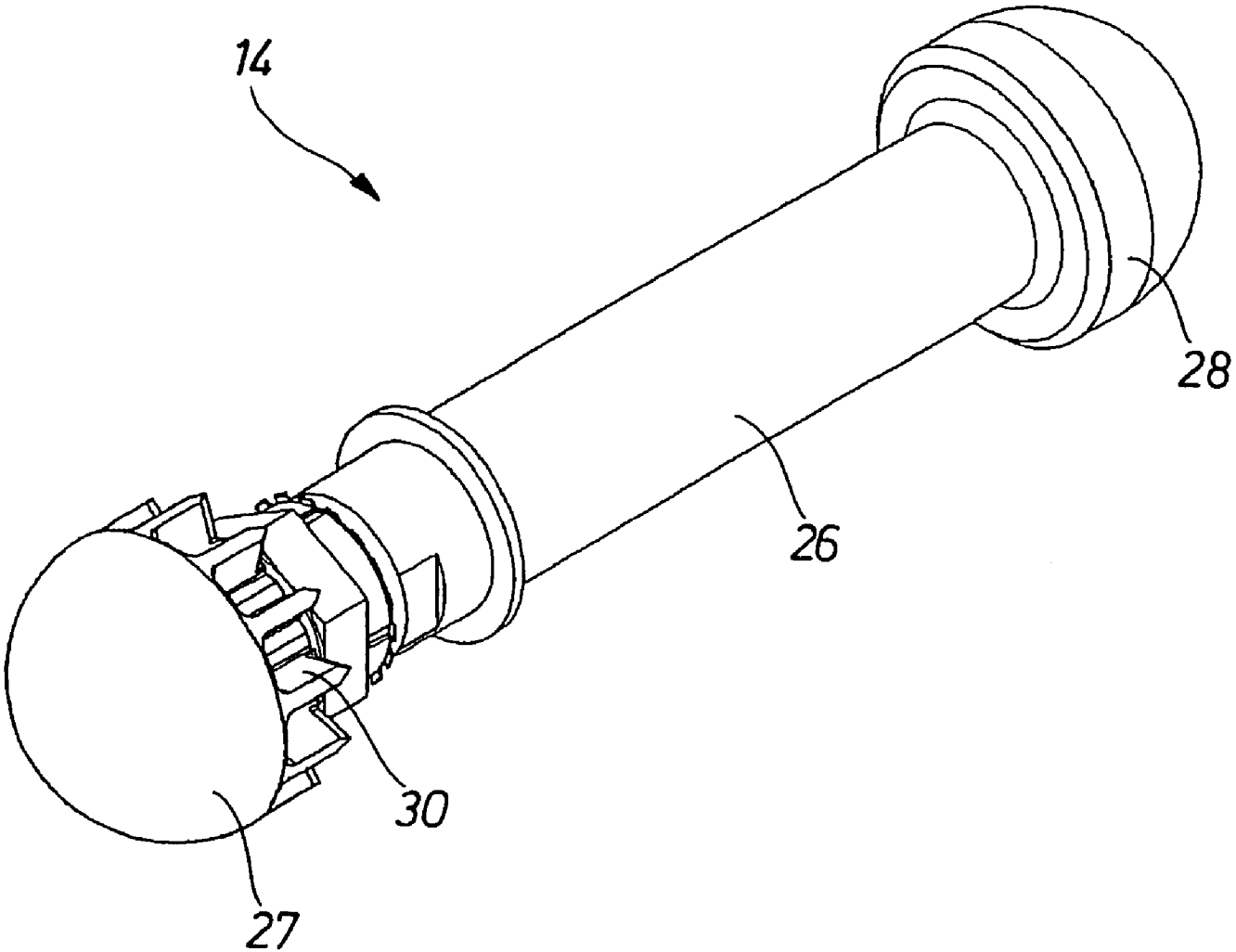
FIG. 8 shows a perspective view of the push rod.

FIGS. 7 and 8 show that the push rod 14 does not have to be designed only as shown in FIGS. 3 and 5. In the solution shown in FIGS. 7 and 8, the push rod 14 consists of several parts, namely, a rod element 26 and a push rod head 27 and 28 mounted at each axial end of the rod element 26. In this regard, the two push rod heads 27, 28 are fastened to the rod element 28 by screw connections 29. This makes it possible, when wear occurs, to replace only individual parts, i.e., only one push rod head.

The push rod head 27 or 28 screwed onto the rod element 26 can be prevented from being accidentally detached by means of a securing device 31.

In the solution according to FIGS. 7 and 8, cooling is improved by providing fins 30 on the push rod head 28 (in the present case, ribs 30 are realized only for the push rod head 27). As is well known, this increases the heat-dissipating surface.

The frictional heat produced between the spherical ends of the push rods and the bearing elements 12, 13 can be reduced by a favorable design of the push rod or can be dissipated by internal and/or external cooling with a medium (cooling air, cooling water, etc.). Bronzes are potential materials for the bearing elements 12, 13, since they are well suited for the removal of heat. Of course, the wear resistance of these materials limits their usefulness. It is also possible to use carbon fiber composite materials for the bearing elements 12, 13. These materials have high-strength properties, but in this case their usefulness is limited by their relatively poor thermal conductivity. Greases can be used for cooling or lubrication, but they should be as thermally stable as possible due to the high temperatures at the point of contact between bearing elements 12, 13 and push rod 14.

The proposal of the invention is characterized by satisfactory kinematics of the components and by a simple and spatially compact design. Inexpensive realization is thus possible. The efficiency of the design can be improved by internal and/or external cooling, especially of the contact point between the bearing element 12, 13 and the push rod 14.

LIST OF REFERENCE NUMBERS AND LETTERS

1 drive spindle
2 drive motor
3 first shaft
4 swivel joint
5 second shaft
6 roll
7 wobbler
8 roll-side spindle head

9 flat journal
9*a* sliding bearing
9*b* sliding bearing
10 axis of rotation of the roll
11 axis of rotation of the second shaft
12 bearing element
13 bearing element
14 push rod
15 end region of the push rod
16 end region of the push rod
17 recess
18 means for mounting the push rod to prevent it from falling out
19 lubricant channel
20 longitudinal bore
21 bearing box for balancing
22 ring
23 securing element
24 locking element
25 projection
26 rod element
27 push rod head
28 push rod head
29 screw connection
30 fins
31 securing device
α angle of inclination
L length of the push rod
D diameter of the push rod
R radius

The invention claimed is:

1. Drive spindle for the main drive of a rolling stand, which has:

a first shaft (3) for transmitting torque from a drive motor (2) to a coupling element, and a second shaft (5) for transmitting the torque from the coupling element via a swivel joint (4) to a roll (6) of the rolling stand, wherein the swivel joint (4) has a wobbler (7), which is rotationally rigidly connected with the roll (6), and a second spindle head (8), which is rotationally rigidly connected with the second shaft (5), and wherein the rotational connection between the wobbler (7) and the spindle head (8) is produced by sliding bearings and a journal (9), which is rotationally rigidly connected with the spindle head (8) but is supported in a way that allows an angle of inclination (a) between the axis of rotation (10) of the roll (6) and the axis of rotation (11) of the second shaft (5), wherein a bearing element (12, 13) for absorbing forces in the direction of the axes of the second shaft (5) and the roll (6) is arranged between the wobbler (7) and the spindle head (8), such that a push rod (14) for transmitting axial forces between the wobbler (7) and the spindle head (8) is arranged between the two bearing elements (12, 13).

2. Drive spindle in accordance with claim 1, wherein the bearing elements (12, 13) are arranged concentrically to the axis of rotation (10) of the roll (6) and the axis of rotation (11) of the second shaft (5), respectively.

3. Drive spindle in accordance with claim 1, wherein each of the bearing elements (12, 13), together with the push rod (14), forms a sliding bearing.

4. Drive spindle in accordance with claim 1, wherein the bearing elements (12, 13) have a concave cross-sectional shape in the area of contact with the push rod (14), and the end regions (15, 16) of the push rod (14) have a convex shape corresponding to this concave shape.

5. Drive spindle in accordance with claim 4, wherein the bearing elements (12, 13) have an essentially hemispherical cross-sectional shape in the area of contact with the push rod (14).

6. Drive spindle in accordance with claim 5, wherein the radius (R) of the hemispherical sections of the bearing elements (12, 13) and push rod (14) is between half as great and twice as great as the diameter (D) of the push rod.

7. Drive spindle in accordance with claim 1, wherein the journal (9) has an essentially plate-like design and a recess (17) for the passage of the push rod (14).

8. Drive spindle in accordance with claim 7, wherein the recess (17) has a conical shape.

9. Drive spindle in accordance with claim 1, comprising means (18) by which the push rod (14) is connected with the wobbler (7) or with the spindle head (8) in a way that prevents it from falling out.

10. Drive spindle in accordance with claim 1, wherein the push rod (14) is designed in the form of a pin.

11. Drive spindle in accordance with claim 10, wherein the ratio of the length (L) of the push rod (14) to its diameter (D) is 4 to 10 and preferably 5.5 to 8.5.

12. Drive spindle in accordance with claim 1, wherein a lubricant channel (19), which passes through the spindle head (8), opens into the contact area between at least one of the bearing elements (12, 13) and the push rod (14) to supply lubricant to the contact area.

13. Drive spindle in accordance with claim 12, wherein the lubricant channel (19) opens only into the contact area between one of the bearing elements (13) and the push rod (14), and that the push rod has a longitudinal bore (20) that passes through it for conveying lubricant into the area of the other bearing element (12).

14. Drive spindle in accordance with claim 1, wherein the bearing elements (12, 13) are produced from a self-lubricating material.

15. Drive spindle in accordance with claim 1, wherein a bearing box (21) that is suitable for applying balancing forces to the second shaft (5) is installed on or at the first shaft (3).

16. Drive spindle in accordance with claim 1, wherein the push rod (14) consists of several components (26, 27, 28) that are connected with one another.

17. Drive spindle in accordance with claim 16, wherein the push rod (14) consists of a rod element (26) and a push rod head (27, 28) mounted at each end of the rod element (26).

18. Drive spindle in accordance with claim 16, wherein the components (26, 27, 28) are connected with one another by screw connections (29).

19. Drive spindle in accordance with claim 1, wherein the push rod (14) has fins (30).

20. Drive spindle in accordance with claim 1, wherein the push rod (14) has at least one bore for passing a cooling medium through it.

21. Drive spindle in accordance with claim 20, wherein at least one bore for the passage of a cooling medium is present in the axial end region of the push rod (14).

* * * * *